US007694388B2

(12) United States Patent
Campbell et al.

(10) Patent No.: US 7,694,388 B2
(45) Date of Patent: Apr. 13, 2010

(54) ADJUSTABLE HINGE

(75) Inventors: Frank W. Campbell, Lake Elmo, MN (US); Bror Fries, Hishult (SE)

(73) Assignee: Creative Research & Development, Inc., Lake Elmo, MN (US)

( * ) Notice: Subject to any disclaimer, the term of this patent is extended or adjusted under 35 U.S.C. 154(b) by 73 days.

(21) Appl. No.: 11/513,336

(22) Filed: Aug. 30, 2006

(65) Prior Publication Data

US 2008/0052873 A1 Mar. 6, 2008

(51) Int. Cl.
*E05D 7/06* (2006.01)

(52) U.S. Cl. ..... 16/239; 16/235; 16/387

(58) Field of Classification Search ..... 16/354, 16/387
See application file for complete search history.

(56) References Cited

U.S. PATENT DOCUMENTS

| | | | | | |
|---|---|---|---|---|---|
| 994,196 | A | | 6/1911 | Reddick | |
| 1,002,394 | A | | 9/1911 | Hanson | |
| 2,940,115 | A | * | 6/1960 | Hansen | 16/246 |
| 3,325,942 | A | | 6/1967 | Bejarano | |
| 3,402,422 | A | * | 9/1968 | Baer | 16/366 |
| 3,423,786 | A | | 1/1969 | Arias, Jr. et al. | |
| 3,445,883 | A | * | 5/1969 | Lowe | 16/387 |
| 3,695,330 | A | * | 10/1972 | Hasbrouck | 160/135 |
| 3,728,758 | A | | 4/1973 | Johansen | |
| 3,952,366 | A | | 4/1976 | Rock et al. | |
| 4,070,728 | A | | 1/1978 | Herman | |
| 4,159,557 | A | | 7/1979 | Pittasch et al. | |
| 4,641,393 | A | * | 2/1987 | Lautenschlager | 15/241 |
| 4,825,507 | A | * | 5/1989 | Killingstad | 16/241 |
| 4,881,296 | A | * | 11/1989 | Marinoni | 16/237 |
| 4,976,008 | A | * | 12/1990 | Baer | 16/354 |
| 4,982,475 | A | | 1/1991 | Killingstad | |
| 4,996,739 | A | * | 3/1991 | Baer | 16/354 |
| 4,999,880 | A | * | 3/1991 | Baer | 16/354 |
| 5,001,810 | A | * | 3/1991 | Baer | 16/302 |
| 5,337,451 | A | * | 8/1994 | Goossens | 16/354 |
| 5,379,487 | A | | 1/1995 | Bowers | |
| 5,381,920 | A | | 1/1995 | Lin | |
| 5,632,064 | A | | 5/1997 | Lautenschlager | |
| 5,788,351 | A | | 8/1998 | Prunty et al. | |
| 5,799,370 | A | | 9/1998 | Davidian et al. | |
| 5,806,144 | A | | 9/1998 | Fries | |
| 6,073,310 | A | * | 6/2000 | Baer | 16/354 |
| 6,202,255 | B1 | * | 3/2001 | Sitter | 16/242 |
| 6,553,621 | B2 | | 4/2003 | Isele | |
| 6,694,568 | B2 | * | 2/2004 | Baer | 16/354 |
| 6,735,823 | B2 | * | 5/2004 | Pelletier | 16/354 |
| 7,406,748 | B2 | * | 8/2008 | Baer | 16/354 |

FOREIGN PATENT DOCUMENTS

| | | | |
|---|---|---|---|
| DE | 4138915 | A1 * | 6/1993 |

(Continued)

*Primary Examiner*—Victor Batson
*Assistant Examiner*—Emily M Morgan
(74) *Attorney, Agent, or Firm*—IPLM Group, P.A.

(57) ABSTRACT

A horizontally adjustable hinge (10) includes a frame leaf (11) and a door leaf (14). A capturing member (16) receives the head (19*a*) of an adjustment screw (19). An adjusting hole (14*e*) allows access for a tool to rotate the adjustment screw (19), and thereby horizontally adjust the hinge (10).

15 Claims, 8 Drawing Sheets

FOREIGN PATENT DOCUMENTS

| | | | |
|---|---|---|---|
| DK | 132347 | | 11/1975 |
| EP | 1 094 183 | A2 | 4/2001 |
| NO | 309619 | | 2/2001 |
| WO | WO 01/84261 | | 11/2001 |
| WO | WO 03/029589 | A1 | 4/2003 |

* cited by examiner

ADJUSTABLE HINGE

BACKGROUND OF THE INVENTION

1. Field of the Invention

This invention relates generally to an adjustable hinge and more particularly to an adjustable hinge that is adjustable in the horizontal direction.

2. Description of the Prior Art

A number of different adjustable hinges have been used to adjust doors relative to the frames in which the doors are mounted. This allows the doors to be level and fit well within the frame. These adjustable hinges may be of a standard variety or a snap-in variety. Adjustable hinges are often more complex and are of greater difficulty to install than non-adjustable hinges. In addition, the adjustable hinges are often time-consuming and somewhat difficult to adjust in manipulating the adjustment mechanisms.

One example of such an adjustable hinge is disclosed in U.S. application Ser. No. 10/786,608 entitled "Hinge Device". In FIG. 24 there is shown an adjustment means 184 that consists of a first screw body 184' which can be screwed into or out of a door frame 182 for abutment with the rear side of a hinge flap 181 and a fixing screw 184". While this is an advantageous design for an adjustable door hinge, it does utilize two parts for the adjustment.

The present invention addresses the designs of the prior art and provides for a simpler design wherein the adjustment screw is captured in one of the leaves of the hinge.

SUMMARY OF THE INVENTION

In one embodiment the invention is a horizontally adjustable hinge for use with a door and frame. The adjustable door and hinge includes a first leaf rotatably connected to a second leaf. The first leaf is adapted and configured to be connected to a door and the second leaf is adapted and configured to be connected to a frame. One of the leaves has a top surface and a bottom surface. A capturing member is operatively connected to the bottom surface. The capturing member has an opening for receiving a head of an adjustable screw. The screw has its head that has a width larger than a width of its shank. The capturing member has opposing sides. The sides, at one location, are spaced at a distance less than the width of the head of the screw, wherein the head of the screw is captured between the bottom surface and the sides and is still able to rotate while captured. The one of the leaves has an access opening for allowing a tool to have access from the top surface to turn the adjustment screw.

In another embodiment the invention is a horizontally adjustable hinge for use with a door and frame. The adjustable hinge includes a first leaf rotatably connected to a second leaf. The first leaf is adapted and configured to be connected to a door and the second leaf adapted and configured to be connected to a frame. One of the leaves has a top surface and a bottom surface. The one of the leaves is formed by extrusion. The bottom surface has an extrusion profile. The extrusion profile extends vertically when installed. The extrusion profile defines a capture member. The profile has openings at each end. The openings are adapted and configured to receive a head of an adjustment screw. The adjustment screw has its head larger than a width of its shank. The extrusion profile has two sides. The sides define the openings and also define a slot in which the screw head is captured. The one of the leaves has an access opening for allowing tool to have access from the top surface to turn the adjustment screw.

In another embodiment, the invention is a horizontally adjustable hinge for use with a door and frame. The adjustable hinge includes a first leaf rotatably connected to a second leaf. The first leaf is adapted and configured to be connected to a door and the second leaf is adapted and configured to be connected to a frame. One of the leaves has a top surface and a bottom surface. The one of the leaves is formed by extrusion. The bottom surface has an extrusion profile. The extrusion profile extends vertically when installed. The extrusion profile defines a capturing member. The profile has openings at each end. The openings are adapted and configured to receive a head of an adjustment screw. The adjustment screw has its head larger than a width of its shank. The extrusion profile has two sides. The sides define the openings and also define a slot in which the screw head is captured. The sides of the extrusion profile define a slot having a wider opening proximate the bottom surface. The sides extend out from the bottom surface. A raised portion is positioned between the opposing sides, wherein the adjusting screw is stabilized when the adjusting hinge is rotated between a maximum gap position to a minimum gap position. At least two securing openings are formed in the one of the leaves. The securing openings being oblong to provide for clearance for securing screws. A covering flange extends generally perpendicular to the bottom surface and along an inner edge. The inner edge is proximate the rotatable connection. An edge flange extends away from the sides and generally parallel to the top surface. The edge flange has a width designed so as to bottom out when the adjustable hinge is at a maximum gap. A depression is formed in the bottom surface and adjacent the covering flange. The depression has a depth designed so as to bottom out when the adjustable hinge is at a minimum gap. The one of the leaves has an access opening for allowing a tool to have access from the top surface to turn the adjustment screw.

DETAILED DESCRIPTION OF A PREFERRED EMBODIMENT

Figure 1:
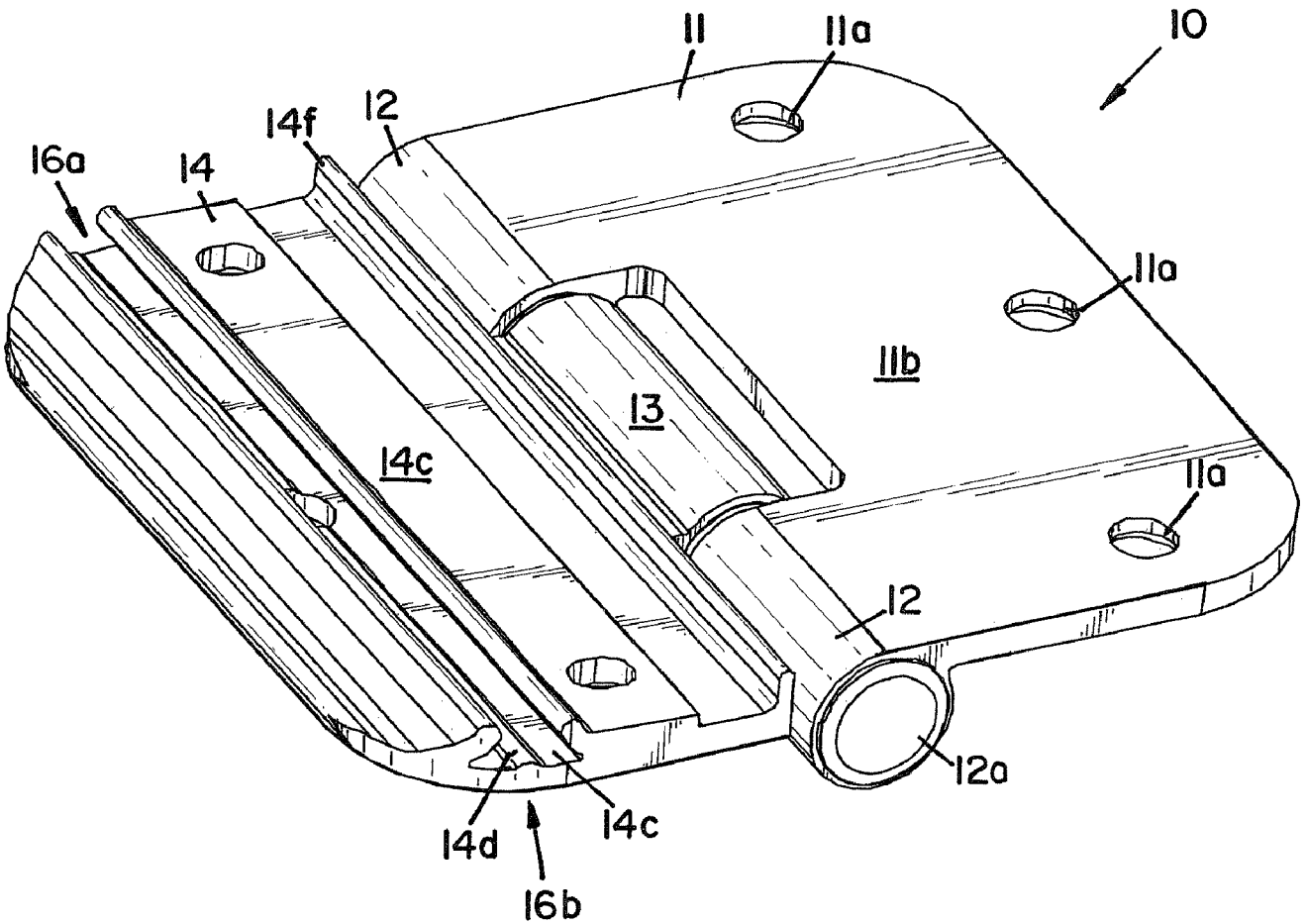
FIG. 1 is a perspective view of an adjustable hinge of the present invention shown generally from below.
Figure 2:
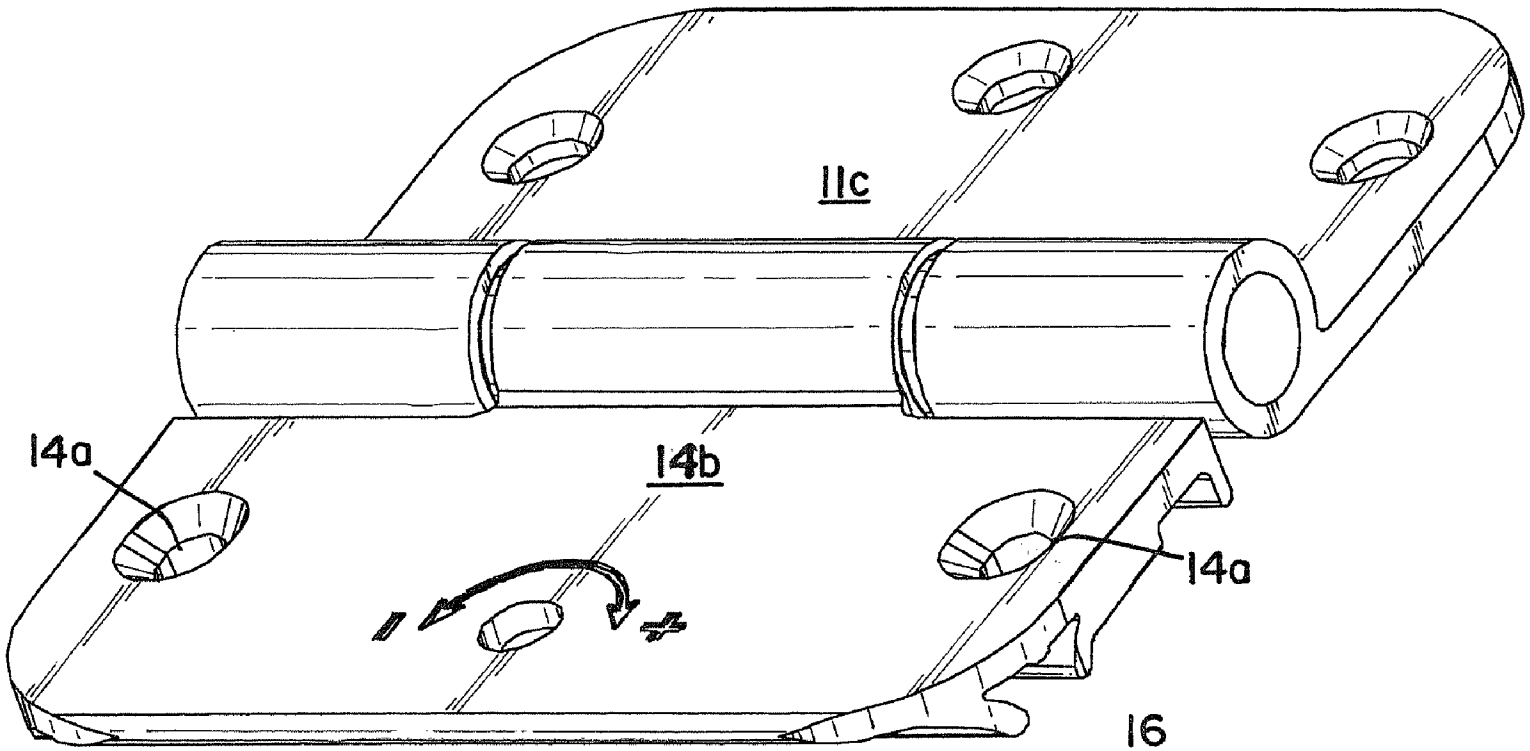
FIG. 2 is a perspective view of the hinge shown in FIG. 1, shown generally from above.

Referring to the drawing, wherein like numerals represent like parts throughout the several views, there is generally disclosed at 10 an adjustable hinge. The adjustable hinge 10 includes a frame leaf 11 having three mounting holes 11*a* formed therein. The mounting holes have a countersunk construction on surface 11*c*. The mounting holes 11*a* are used to secure the frame leaf 11 to a frame 80. The frame leaf 11 is generally planar and suitable mounting screws 20 or other mounting mechanisms are utilized, as is well known in the art. The frame leaf 11 has two spaced knuckles 12 that are operatively connected to the leaf frame 11. The spaced knuckles 12 mate with a knuckle 13 on a door leaf 14. End cap 12*a* may be provided to provide a finished look to the knuckle 12. The end cap 12*a* is optionally threaded so that it may be screwed into the knuckle. A bore extends through the knuckles 12 and 13 and the leaves 11 and 14 are engaged together with a pivot pin 25 which enables the leaves 11, 14 to pivot with respect to each other.

The frame leaf 11 has two generally planar surfaces 11*b* and 11*c*. The thickness of the frame leaf 11 is such that it matches with the thickness of a notch, or continuous groove, formed in the frame 80 when mounted, which is well known in the art.

Figure 3:
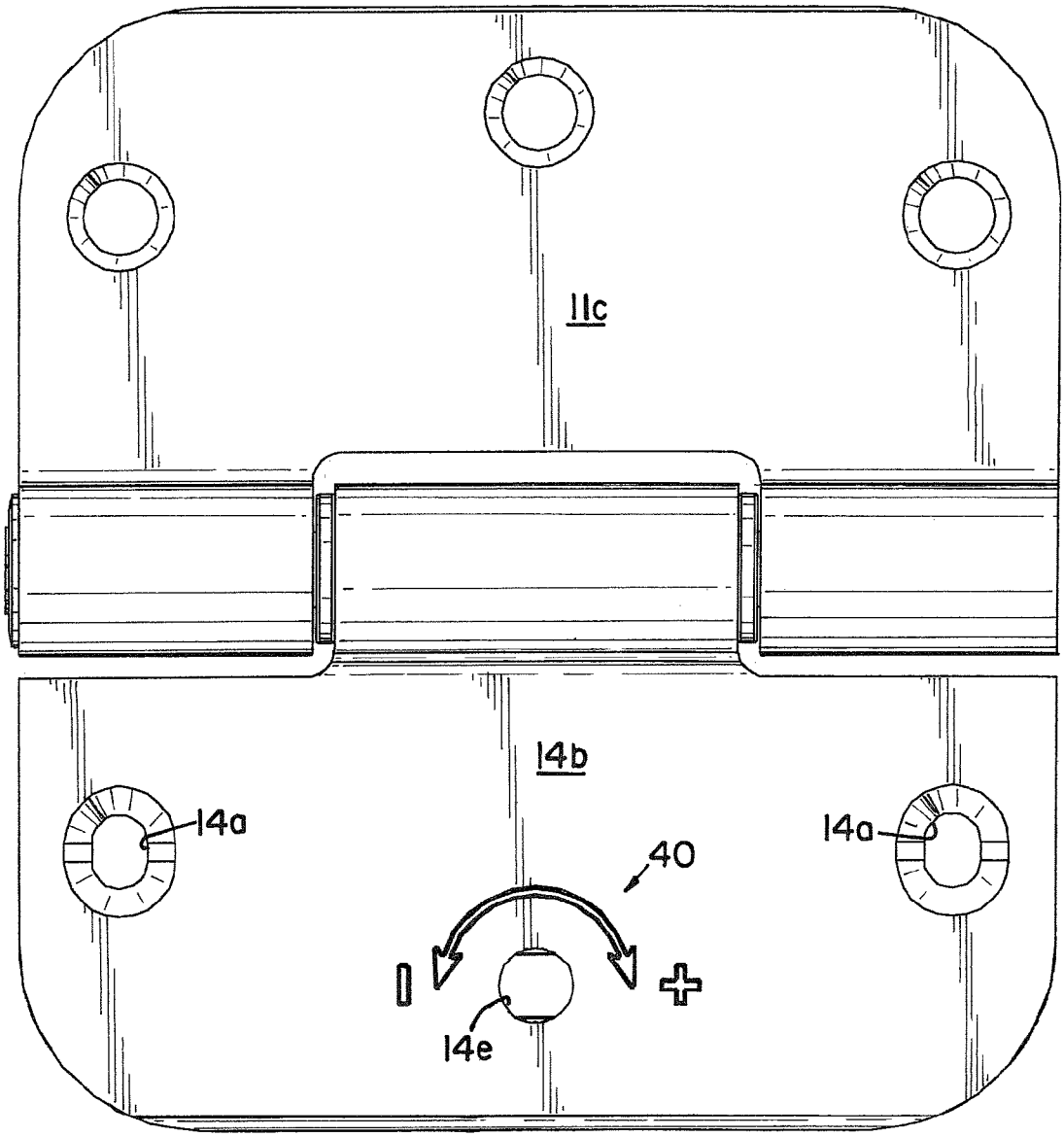
FIG. 3 is a top plan view of the hinge shown in FIG. 2.

The door leaf 14 has two mounting holes 14*a*. The mounting holes 14*a* are generally oblong and have a countersunk construction on the generally planar surface 14*b*. As can be seen best in FIG. 3, the mounting holes 14*a* are generally oblong to allow for movement of mounting screws 15, as will be described more fully hereafter.

Figure 4:
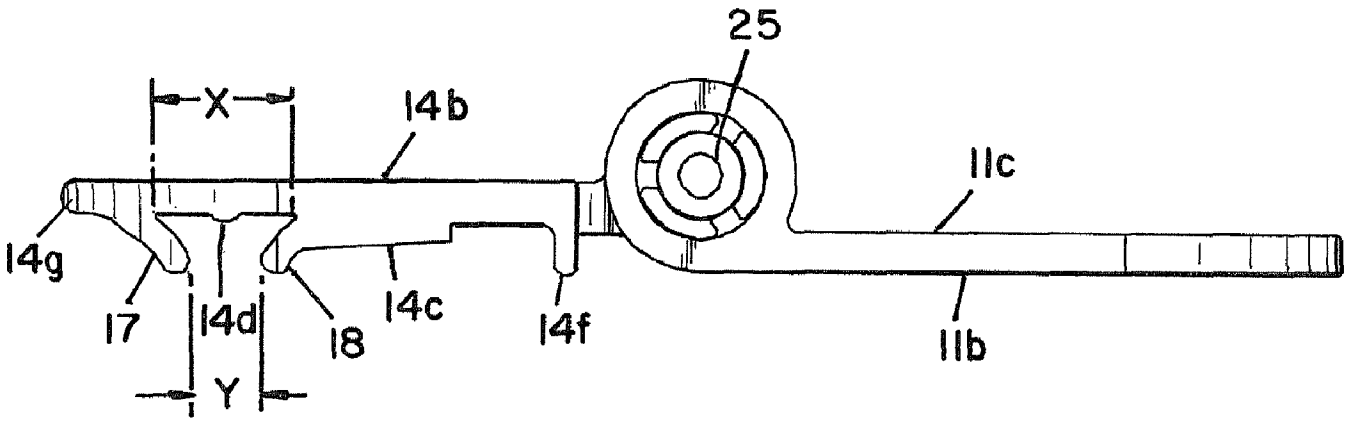
FIG. 4 is a side elevational view of the hinge shown in FIG. 2.
Figure 5:
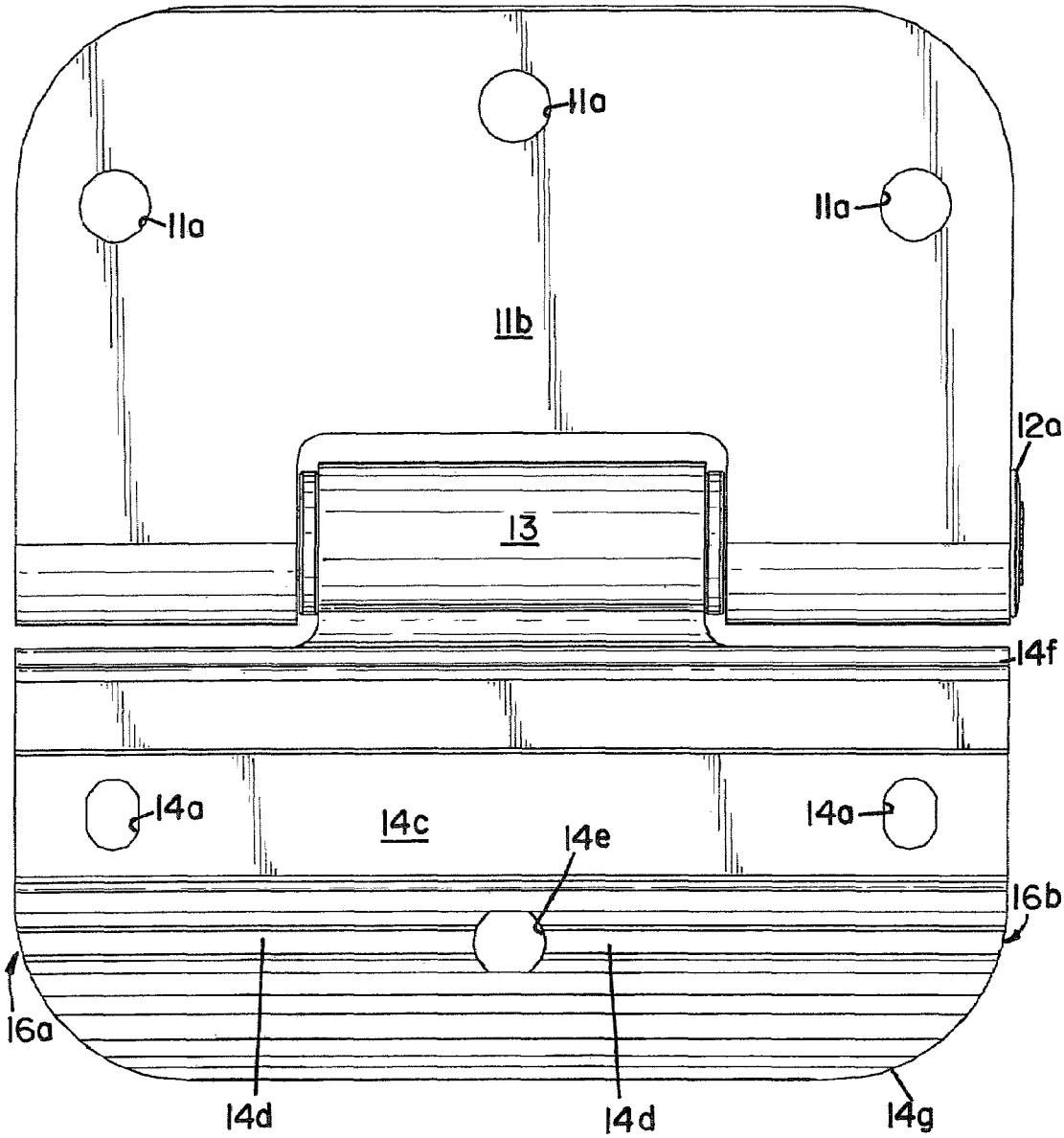
FIG. 5 is a bottom plan view of the hinge shown in FIG. 3.

The mounting screws 15 have a generally circular shaft 15*a*. The surface 14*c*, which is on the opposite side of the door leaf 14 from surface 14*b* is not planar. There are several features that are defined in the door leaf 14 as will be described more fully hereafter. The door leaf 14 and frame leaf 11 are preferably formed by extrusion and are constructed from aluminum, although other suitable materials and construction techniques may also be utilized. However, the extrusion process is advantageous for defining the features of the door leaf 14. The door leaf 14 includes a capturing member 16. The capturing member 16 includes a first angled side wall 17 and a second angled side wall 18. The side walls 17 and 18 extend away from the surface 14*c* such that proximate the surface 14*c* they are spaced further apart than they are away from the surface 14*c*. The distance X is greater than the distance Y. Further, the distance X is larger than they width of the head 19*a* of an adjustment screw 19. However, the distance Y is less than the width of the head 19*a* and greater than the diameter of the shaft 19*b*. Accordingly, the head 19*a* may be captured in the capturing member 16. The capturing member 16 has a first opening 16*a* and a second opening 16*b*. The head 19*a* of the adjustment screw 19 may be slid into either opening 16*a* or 16*b*, thereby placing the adjustment screw head 19*a* into the slot defined between the side wall 17 and 18 and the surface 14*c*. The surface 14*c*, as seen in FIG. 4, is irregular, and not planar like the surface 14*d*. The portion of the surface 14*c* that is between the side walls 17 and 18 has a raised portion 14*d*. The side walls 17 and 18 and the raised portion 14*d* are extruded and run the length of the door leaf 14.

An adjustment hole 14*e* is formed in the door leaf 14. The adjustment hole 14*e* is positioned in the slot defined by the sidewalls 17 and 18. Further, the adjustment hole 14*e* is centrally located through the raised portion 14*d*. The raised portion 14*d* extends up to the adjustment hole 14*e* on both sides of the hole 14*e*, so that the head 19*a* of the adjustment screw 19 will be positioned on top of the raised portion 14*d*. A covering flange 14*f* extends generally perpendicular to the bottom surface 14*c* and runs along an inner edge of the door leaf 14. The inner edge is proximate the rotatable connection formed by the knuckles 12 and 13. This covering flange provides for a visual barrier to make it more difficult for a person to see between the knuckles 12 and 13 and the door leaf 14. This provides for a more aesthetic appearance.

An edge flange 14*g* extends generally parallel to the top surface 14*b* and away from the sides 17 and 18. As will be described more fully hereafter, the width of the edge flange 14*g* is designed so that the edge flange 14*g* will bottom out, or contact the door, when at a maximum gap.

In the embodiment shown, the frame leaf 11 is mounted to a frame 80 by mounting screws 20. The door leaf 14 is mounted to a door 35. The planar surface 14*c* is mounted adjacent the door 35. While the features shown on the surface 14*c* are shown on the door leaf 14, it is understood that the features could instead be applied to the frame leaf 11. However, the installation will be described in FIGS. 6-8 where the features are applied to the door leaf 14.

Figure 6:
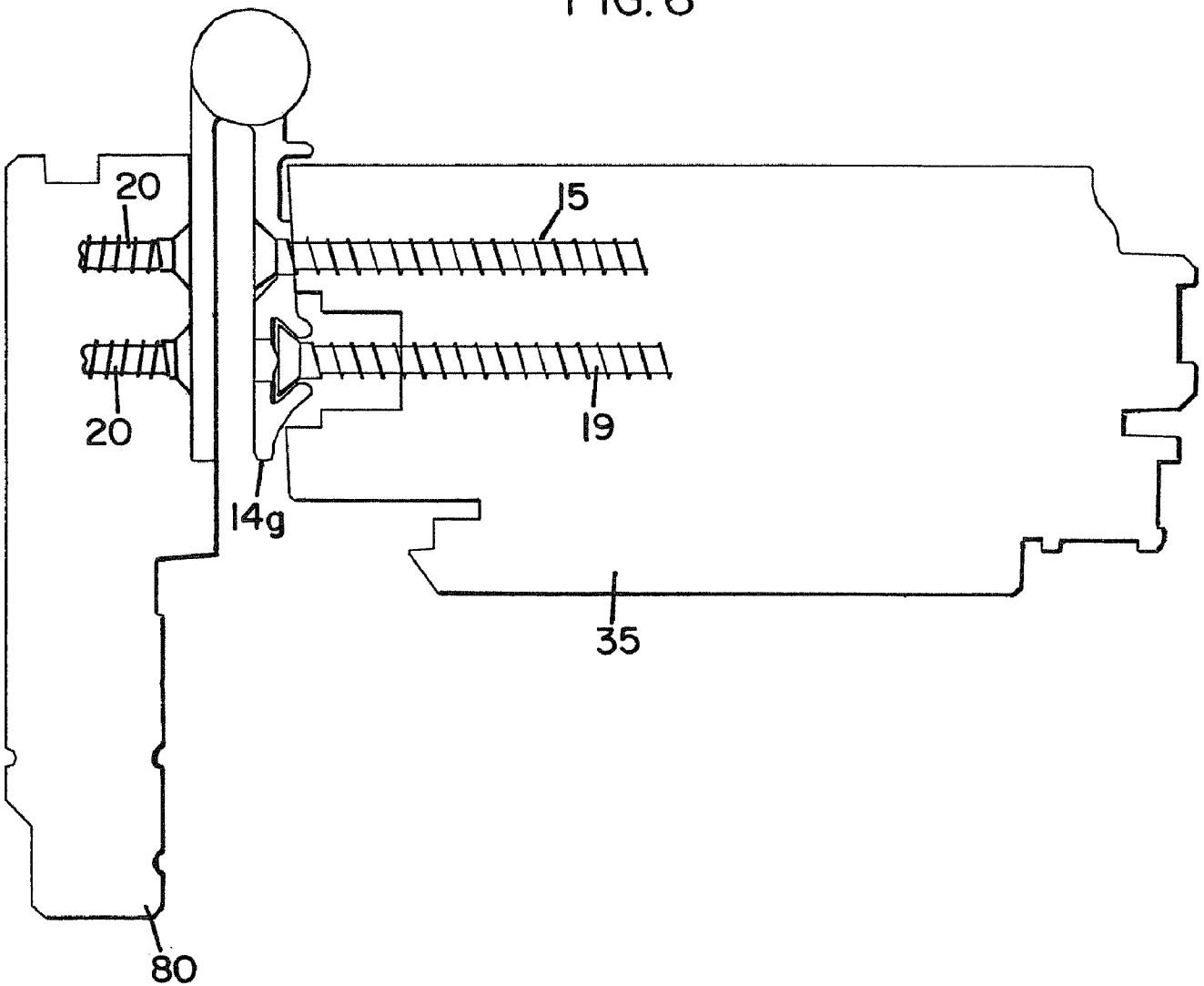
FIG. 6 is a schematic representation showing the hinge of FIG. 1 installed in a door with a nominal gap.
Figure 7:
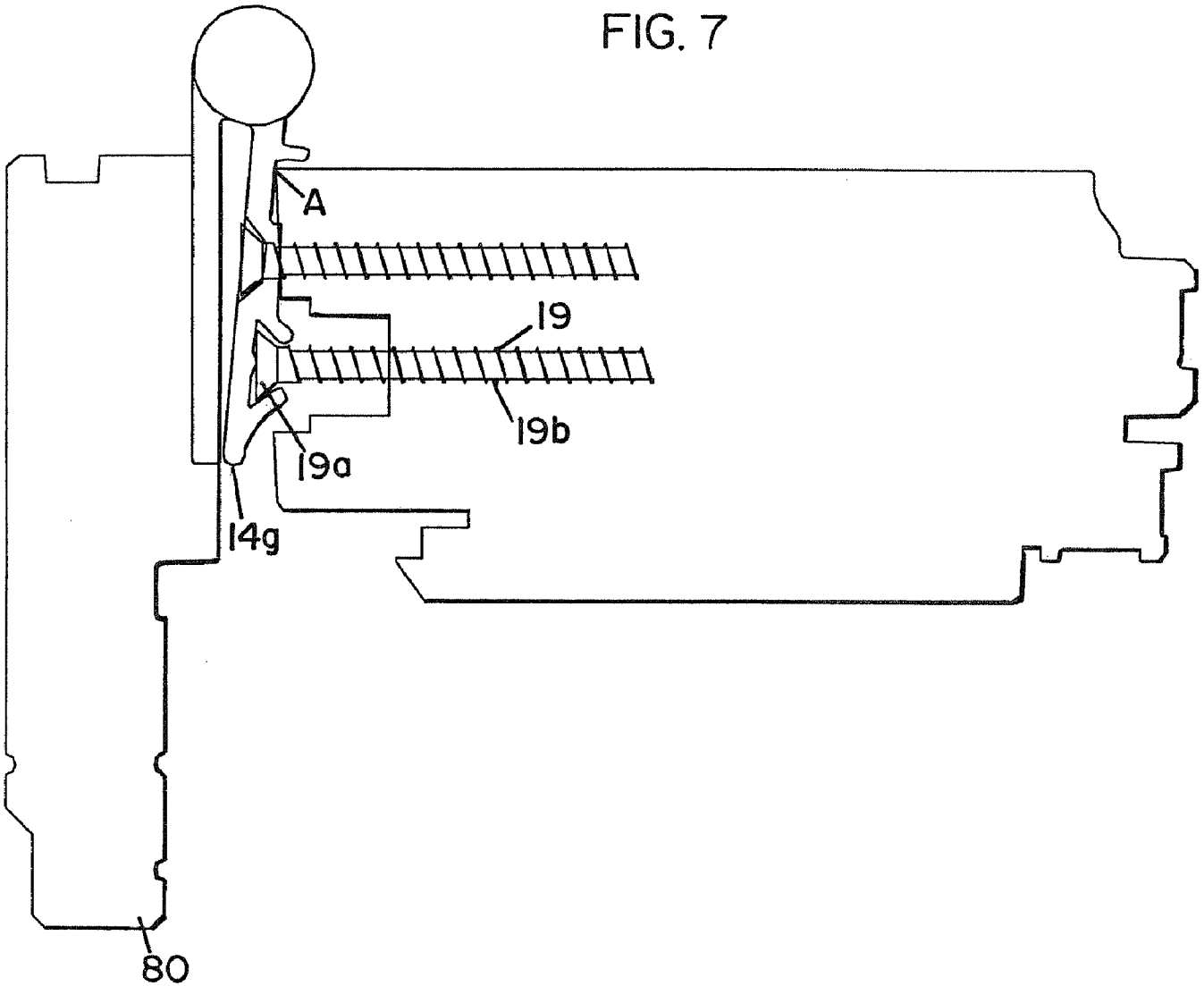
FIG. 7 is a schematic representation showing the hinge of FIG. 1 installed in a door with a minimal gap.

In FIG. 6, the installation of the adjustable hinge 10 is shown with a nominal gap between the door 35 and frame 80. The frame leaf 11 is secured to the frame 80, as previously described. Then, the head 19*a* of an adjustment screw 19 is slid into the slot defined by the side walls 17 and 18. The head 19*a* can enter the slot either through opening 16*a* or 16*b*. The adjusting screw 19 is then captured by the capturing member 16. The door leaf 14 is secured to the door 35 by screws 15. Adjustment screw 19 is also screwed into the door 35. A screwdriver, or suitable driving tool, is inserted through the opening 14*e* and the screw is rotated to drive into the door 35. Indicia 40 is positioned on the surface 14*b*. The indicia 40 is a + and a – with a two-headed arrow. This indicated turning to the right increases the gap and turning to the left decreases the gap. As viewed in FIG. 3, continual rotation will lead to a larger gap and less rotation will yield a smaller gap. FIG. 7 shows a minimum gap. There, the adjustment screw 19 has been rotated counterclockwise from the position shown in FIG. 6. Since the mounting screws 15 are not being moved in or out, the counterclockwise rotation of the adjustment screw 19 will cause the door leaf 14 to pivot closer to the frame leaf 11. This will close the gap between the door 35 and frame 80. In doing so, the head 19*a* of the adjustment screw 19 pivots on the raised portion 14*d*, which acts to stabilize the screw 19. Since the screws 15 do not move in the door 35, the oblong holes provide for a clearance as the door leaf 14 is pivoted. The surface 14*c* contacts the door 35 at point A, at the same time that the edge flange 14*g* is contacting the frame leaf 11. That is, they bottom out at the same time.

Figure 8:
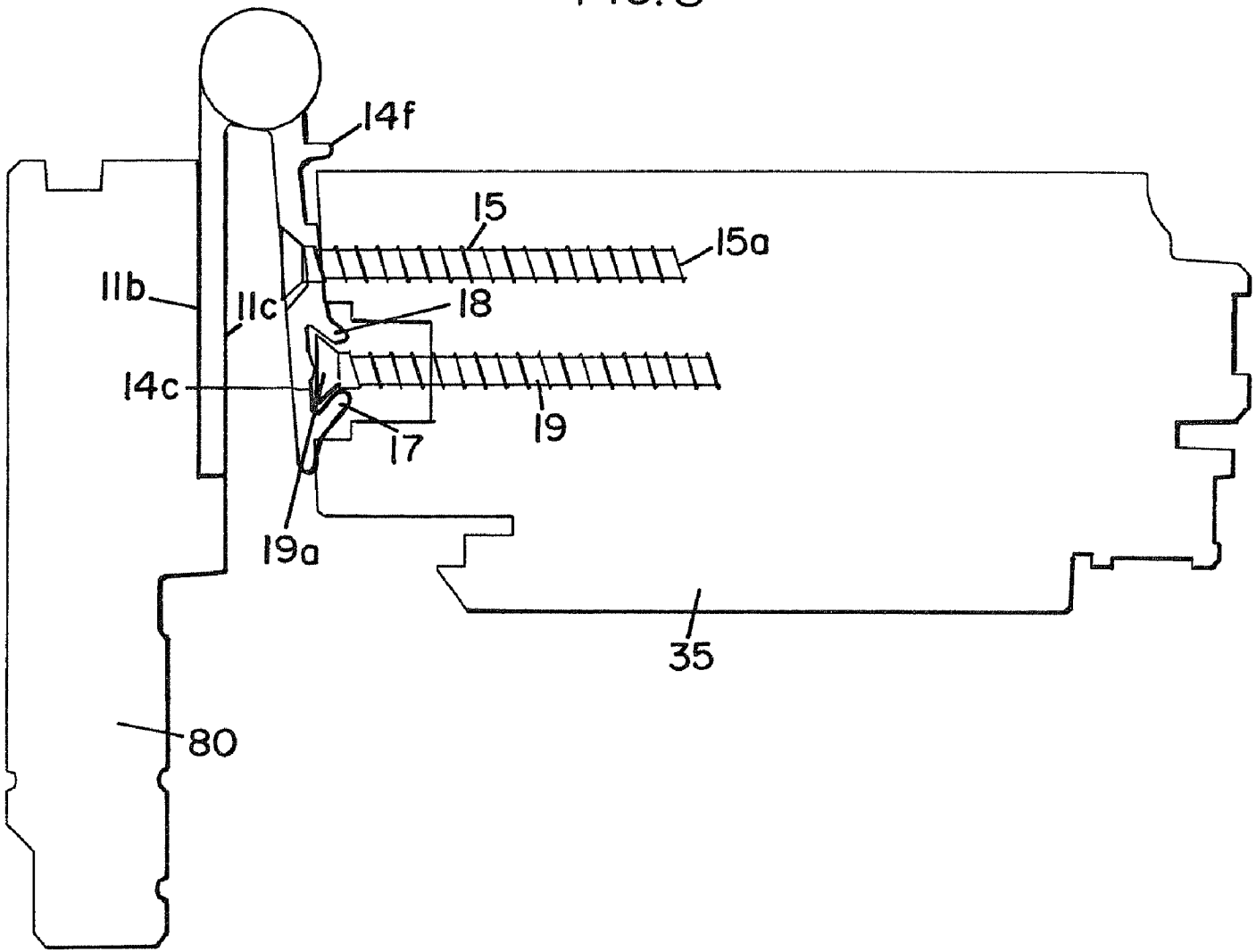
FIG. 8 a schematic representation showing the hinge of FIG. 1 installed in a door with a maximum gap.

FIG. 8 shows the adjustable hinge 10 adjust for a maximum gap. There, as viewed in FIG. 3, the adjustment screw 19 would be rotated to the right. This causes the door leaf 14 to pivot away from the frame leaf 11, thereby increasing the gap between the door 35 and frame 80. The edge flange 14*g* is sized to contact the door 35 at the point where the screw head 19*a* is contacting the side wall 18 and the surface 14*c*, thus these three are bottoming out at the same time.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A horizontally adjustable hinge for use with a door and frame, the adjustable hinge comprising:

(a) a first leaf rotatably connected to a second leaf;

(b) the first leaf adapted and configured to be connected to a door and the second leaf adapted and configured to be connected to a frame;

(c) one of the leaves having a top surface and a bottom surface, the bottom surface abutting one of the door and frame;

(d) an adjustment screw capturing member operatively connected to the bottom surface, the capturing member having an opening for receiving a head of an adjustment screw, the screw having its head having a width larger than a width of its shank, the capturing member configured to allow the adjustment screw to slide a longitudinal length of the leaf into position;

(e) the capturing member having opposing sides, the sides, at one location, spaced at a distance less than the width of the head of the screw and at another location greater than the width of the head of the screw, wherein the head of the screw is captured between the bottom surface and the sides and is still rotatable while captured, the bottom surface limiting movement of the adjustment screw toward the bottom surface and the sides limiting movement of the adjustment screw away from the bottom member, rotation of the adjustment screw, while captured, horizontally adjusts the hinge; and (f) the one of the leaves having an access opening for allowing a tool to have access from the top surface to turn the adjustment screw.

2. The adjustable hinge of claim 1, the capturing member is integral with the one of the leaves.

3. The adjustable hinge of claim 2, the capturing member has an extruded profile, the profile having an end opening into which a head of the adjustment screw is slideable to be over the access opening.

4. The adjustable hinge of claim 1, further comprising at least two securing openings formed in the one of the leaves, the securing openings being oblong to provide for clearance for securing screws.

5. The adjustable hinge of claim 3, further comprising a covering flange, the covering flange extending generally perpendicular to the bottom surface and along an inner edge, the inner edge proximate the rotatable connection.

6. The adjustable hinge of claim 1, further comprising an edge flange extending away from the sides and generally parallel to the top surface, the edge flange having a width designed so as to bottom out when the adjustable hinge is at a maximum gap.

7. The adjustable hinge of claim 6, further comprising a depression formed in the bottom surface and adjacent the covering flange, the depression having a depth designed so as to bottom out when the adjustable hinge is at a minimum gap.

8. A horizontally adjustable hinge for use with a door and frame, the adjustable hinge comprising:

(a) a first leaf rotatably connected to a second leaf;

(b) the first leaf adapted and configured to be connected to a door and the second leaf adapted and configured to be connected to a frame;

(c) one of the leaves having a top surface and a bottom surface, the bottom surface abutting one of the door and frame;

(d) the one of the leaves formed by extrusion, the bottom surface having an extrusion profile, the extrusion profile extending vertically when installed;

(e) the extrusion profile defining an adjustment screw capturing member, the profile having openings at each end, the openings adapted and configured to receive a head of an adjustment screw, the adjustment screw having its head larger than a width of its shank, the capturing member configured to allow the adjustment screw to slide along a longitudinal length of the leaf into position;

(f) the extrusion profile having two sides, the sides defining the openings and also defining a slot in which the adjustment screw head is captured, the bottom surface limiting movement of the adjustment screw toward the bottom surface and the sides limiting movement of the adjustment screw away from the bottom member, while still allowing rotation of the adjustment screw head, rotation of the adjustment screw head, while captured, horizontally adjusts the hinge; and (g) the one of the leaves having an access opening for allowing a tool to have access from the top surface to turn the adjustment screw.

9. The adjustable hinge of claim 8, further comprising the sides of the extrusion profile defining a slot having a wider opening proximate the bottom surface, the sides extending out from the bottom surface.

10. The adjustable hinge of claim 8, further comprising at least two securing openings formed in the one of the leaves, the securing openings being oblong to provide for clearance for securing screws.

11. The adjustable hinge of claim 8, further comprising a covering flange, the covering flange extending generally perpendicular to the bottom surface and along an inner edge, the inner edge proximate the rotatable connection.

12. The adjustable hinge of claim 8, further comprising an edge flange extending away from the sides and generally parallel to the top surface, the edge flange having a width designed so as to bottom out when the adjustable hinge is at a maximum gap.

13. The adjustable hinge of claim 12, further comprising a depression formed in the bottom surface and adjacent the covering flange, the depression having a depth designed so as to bottom out when the adjustable hinge is at a minimum gap.

14. A horizontally adjustable hinge for use with a door and frame, the adjustable hinge comprising:

(a) a first leaf rotatably connected to a second leaf;

(b) the first leaf adapted and configured to be connected to a door and the second leaf adapted and configured to be connected to a frame;

(c) one of the leaves having a top surface and a bottom surface, the bottom surface abutting one of the door and frame;

(d) the one of the leaves formed by extrusion, the bottom surface having an extrusion profile, the extrusion profile extending vertically when installed;

(e) the extrusion profile defining an adjustment screw capturing member, the profile having openings at each end, the openings adapted and configured to receive a head of an adjustment screw, the adjustment screw having its head larger than a width of its shank, the profile having an end opening into which a head of the adjustment screw is slideable to be over the access opening, the capturing member configured to allow the adjustment screw to slide along a longitudinal length of the leaf into position;

(f) the extrusion profile having two sides, the sides defining the openings and also defining a slot in which the adjustment screw head is captured, the bottom surface limiting movement of the adjustment screw toward the bottom surface and the sides limiting movement of the adjustment screw away from the bottom member, while still allowing rotation of the adjustment screw head, rotation of the adjustment screw head, while captured, horizontally adjusts the hinge, the sides of the extrusion profile defining a slot having a wider opening proximate the bottom surface, the sides extending out from the bottom surface;

(g) at least two securing openings formed in the one of the leaves, the securing openings being oblong to provide for clearance for securing screws;

(h) a covering flange, the covering flange extending generally perpendicular to the bottom surface and along an inner edge, the inner edge proximate the rotatable connection;

(i) an edge flange extending away from the sides and generally parallel to the top surface, the edge flange having a width designed so as to bottom out when the adjustable hinge is at a maximum gap;

(j) a depression formed in the bottom surface and adjacent the covering flange, the depressing having a depth designed so as to bottom out when the adjustable hinge is at a minimum gap; and (k) the one of the leaves having an access opening for allowing a tool to have access from the top surface to turn the adjustment screw.

15. The adjustable hinge of claim 8, the profile having an end opening into which a head of the adjustment screw is slideable to be over the access opening.

* * * * *